US007276129B2

(12) United States Patent
Tominaga et al.

(10) Patent No.: US 7,276,129 B2
(45) Date of Patent: Oct. 2, 2007

(54) SURFACE TREATING METHODS OF TITANIUM PARTS

(75) Inventors: Tadayoshi Tominaga, Aichi-ken (JP); Naoki Komoto, Aichi-ken (JP); Teruhisa Ushio, Aichi (JP)

(73) Assignee: Aisan Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/715,122

(22) Filed: Nov. 18, 2003

(65) Prior Publication Data

US 2004/0118372 A1 Jun. 24, 2004

(30) Foreign Application Priority Data

Nov. 20, 2002 (JP) ..... 2002-336789

(51) Int. Cl.
*C23C 8/10* (2006.01)

(52) U.S. Cl. ..... 148/281; 148/284

(58) Field of Classification Search ..... 148/240, 148/276, 277, 281, 284
See application file for complete search history.

(56) References Cited

U.S. PATENT DOCUMENTS

| | | | | |
|---|---|---|---|---|
| 4,263,060 | A * | 4/1981 | Gaucher et al. | 428/336 |
| 5,051,140 | A * | 9/1991 | Mushiake et al. | 148/281 |
| 6,210,807 | B1 * | 4/2001 | Dong et al. | 428/472 |
| 6,294,029 | B1 * | 9/2001 | Sakate et al. | 148/211 |
| 6,451,129 | B2 * | 9/2002 | Sato et al. | 148/237 |
| 6,592,683 | B2 * | 7/2003 | Hirose et al. | 148/276 |
| 6,612,898 | B1 * | 9/2003 | Ohmi et al. | 148/280 |
| 2003/0162042 | A1 * | 8/2003 | Kurisu et al. | 428/472.1 |

FOREIGN PATENT DOCUMENTS

| | | |
|---|---|---|
| JP | 05-009703 | 1/1993 |
| JP | 07-310513 | 11/1995 |
| JP | 08-021216 | 1/1996 |
| JP | 08-104970 | 4/1996 |
| JP | 11-029847 | 2/1999 |
| JP | 11-092911 | 4/1999 |
| JP | 11117056 | 4/1999 |

* cited by examiner

*Primary Examiner*—Roy King
*Assistant Examiner*—Ngoclan T. Mai
(74) *Attorney, Agent, or Firm*—Dennison, Schultz & MacDonald

(57) ABSTRACT

Surface treating methods of a titanium part may include the steps of determining an effective thickness of a hard oxide film to be formed on a surface of the titanium part, determining an effective surface roughness of the hard oxide film, and oxidation treating the surface of the titanium part under a desired treating temperature and a desired treating time such that both of the determined effective thickness and effective surface roughness are satisfied.

4 Claims, 7 Drawing Sheets

SURFACE TREATING METHODS OF TITANIUM PARTS

This application claims priority to Japanese Patent Application Serial Number 2002-336789, the contents of which are incorporated herein by reference.

BACKGROUND OF THE INVENTION

1. Field of the Invention

The present invention relates to surface treating methods of titanium parts. Moreover, the present invention relates to engine valves that are treated by utilizing such surface treating methods.

2. Description of the Related Art

A surface treating method of a titanium part is taught, for example, by Japanese Laid-open Patent Publication Number 11-117056, in which the titanium part is oxidized in order to produce a wear resistant hard oxide film on its surface. In this known art, an engine valve made from a metastable β titanium alloy is exemplified as the titanium part, because it has been generally known that when an α-β titanium alloy is oxidized, its fatigue strength is reduced.

In addition, it has been conventionally believed that thicker oxide films (e.g., more than 30 micrometer) are more appropriate than thinner oxide films.

SUMMARY OF THE INVENTION

It is, accordingly, one object of the present teachings to provide improved surface treating methods of titanium parts.

In one embodiment of the present teachings, a surface treating method of a titanium part may include the steps of previously determining an effective thickness of a hard oxide film to be formed on a surface of the titanium part, previously determining effective surface roughness of the hard oxide film, and oxidation treating the surface of the titanium part under a desired treating temperature and a desired treating time such that both of the determined effective thickness and effective surface roughness are satisfied.

According to the present method, the treated titanium part may preferably have desired fatigue strength and desired wear resistance.

Other objects, features and advantage of the present invention will be ready understood after reading the following detailed description together with the accompanying drawings and the claims.

DETAILED DESCRIPTION OF THE INVENTION

Figure 1:
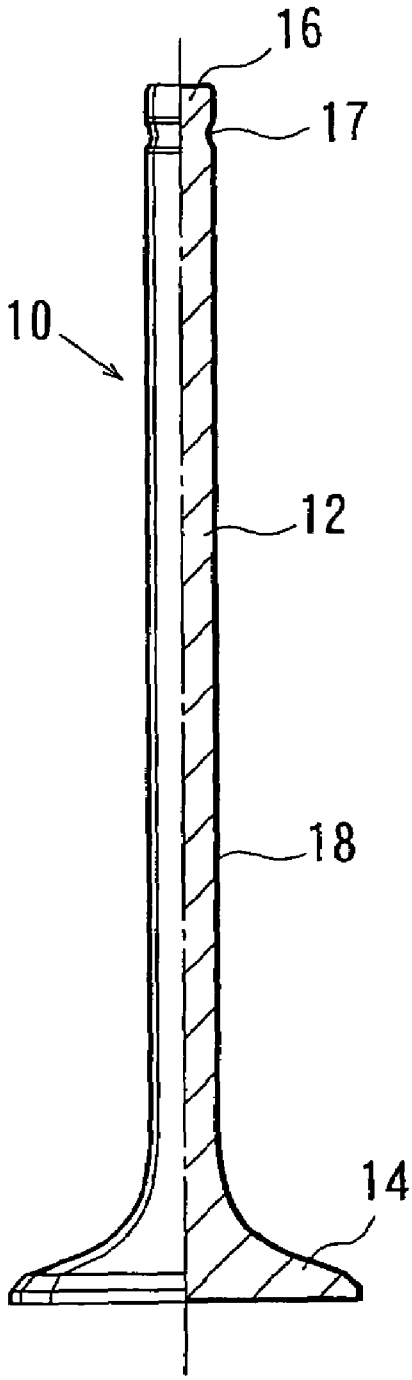
FIG. 1 is a side view, partially in section, of a representative engine valve according to a representative embodiment of the present teachings.
Figure 2:
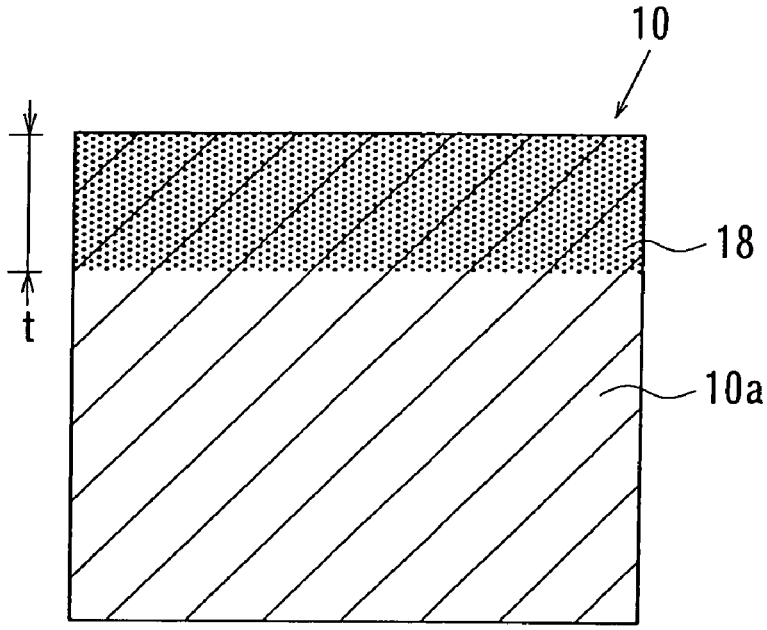
FIG. 2 is a partially enlarged schematic cross-sectional view of the engine valve.

A detailed representative embodiment of the present teachings is shown in FIGS. 1-10, in which a titanium engine valve 10 shown in FIG. 1 is exemplified as a titanium part. The titanium engine valve 10 is made from a Ti-6Al-4V alloy by forging. The Ti-6Al-4V alloy is a typical α-β titanium alloy that has good strength and toughness as well as excellent corrosion resistance. Further, the term "titanium" is used herein to mean "pure titanium" and "titanium alloy."

As shown in FIG. 1, the titanium engine valve 10 may preferably be in one piece and includes a valve stem 12, and an enlarged valve face portion 14 that is continuously formed in one axial end (lower end) of the valve stem 12. The other axial end (upper end) 16 of the valve stem 12 is formed by grinding an annular groove 17. As will be appreciated, the groove 17 is formed in order to engage a cotter (not shown) that is used to attach a valve retainer (not shown).

The valve stem 12 and the valve face portion 14 of the valve 10 are appropriately circumferentially finished by machining (grinding or cutting). Thereafter, the finished valve 10 is entirely treated by an oxidation treatment, thereby forming a hard oxide film 18 on its surface in order to increase wear resistance. (An unoxidized base metal portion of the valve 10 is herein designated by 10*a* (FIG. 2).) As will be recognized, the oxidation treatment is performed by heating the valve 10 in an oxygen containing heating furnace (not shown).

In order to find appropriate surface treating methods (i.e., to determine appropriate oxidizing conditions), various tests are performed. The tests that are performed will now be described in detail.

First, a plurality of sets of samples of an actual engine valve 10 (Samples 1-6) are prepared and are oxidation treated under different treating conditions by changing treating temperatures and treating times. Naturally, each of these sample valves prior to the oxidation treatment is faithfully realized with regard to shape, metallographic structure after forging, and surface conditions after heat treating. Treating conditions of these sets of sample valves are as follows:

Sample 1: Not treated (Control)

Sample 2: Treating temperature* of 670 degrees C. and treating time of 1 hour

Sample 3: Treating temperature* of 670 degrees C. and treating time of 16 hours

Sample 4: Treating temperature* of 730 degrees C. and treating time of 8 hours

Sample 5: Treating temperature* of 820 degrees C. and treating time of 1 hour

Sample 6: Treating temperature* of 820 degrees C. and treating time of 4 hours

* The treating temperature may have an error of approximately ±2-3 degrees C.

Figure 3:
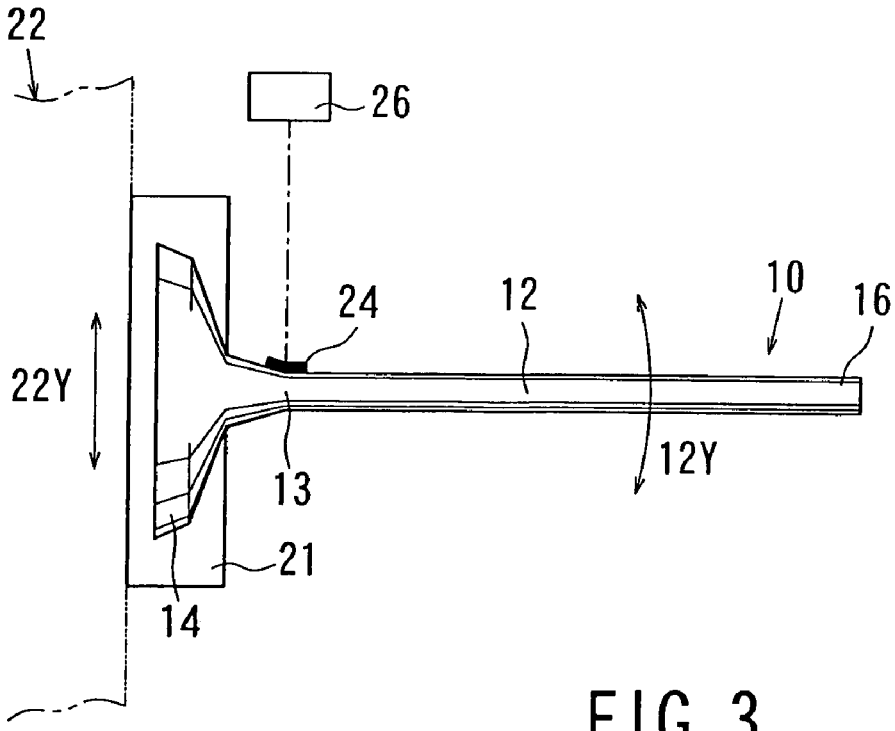
FIG. 3 is a schematic view of a fatigue strength tester.

Fatigue strength tests are carried out with regard to these sets of sample valves (Samples 1-6) by utilizing a fatigue strength tester. First, as shown in FIG. 3, the sample valves 10 of each set of samples are attached to a support 21 by clamping the valve face portion 14. Thereafter, the support 21 is subjected to vibration 22Y by a vibrator 22, so that the valve stem 12 of a sample valve 10 attached to the support 21 is vibrated in a direction 12Y and is periodically flexed and deformed. As will be recognized, the applied vibration 22Y has a special frequency that corresponds to a resonant frequency of a valve 10. When the valve stem 12 of a sample valve 10 is periodically flexed, stress concentration is produced around a juncture 13 of the valve stem 12 and the valve face portion 14. Strain or distortion caused by the stress concentration thus produced is measured by a strain gauge 24 that was previously attached to the juncture 13. The strain thus measured is transmitted to a processor such as a computer 26. The computer 26 calculates the "stress amplitude" at the time when a crack C (FIG. 6) is formed on the juncture 13 and represents the calculated stress amplitude. In these fatigue strength tests, the sample valves 10 of each of Samples 1-6 are respectively measured under different or various repeat counts (cycles) of vibration. As will be recognized, the stress amplitude directly corresponds to "fatigue strength" of the valve 10.

The fatigue strength tests are carried out at room temperature, because oxidized Ti-6Al-4V alloy generally has inferior fatigue strength at room temperature as compared with higher temperatures (e.g., 300 degree C.). In addition, the vibrator 22 used herein is a commercially available vibration testing machine. Further, because the fatigue strength tests in this embodiment use samples of the actual engine valves 10 and not the usual test pieces, it is possible to reliably evaluate the fatigue strength of an actual engine valve 10.

Figure 4:
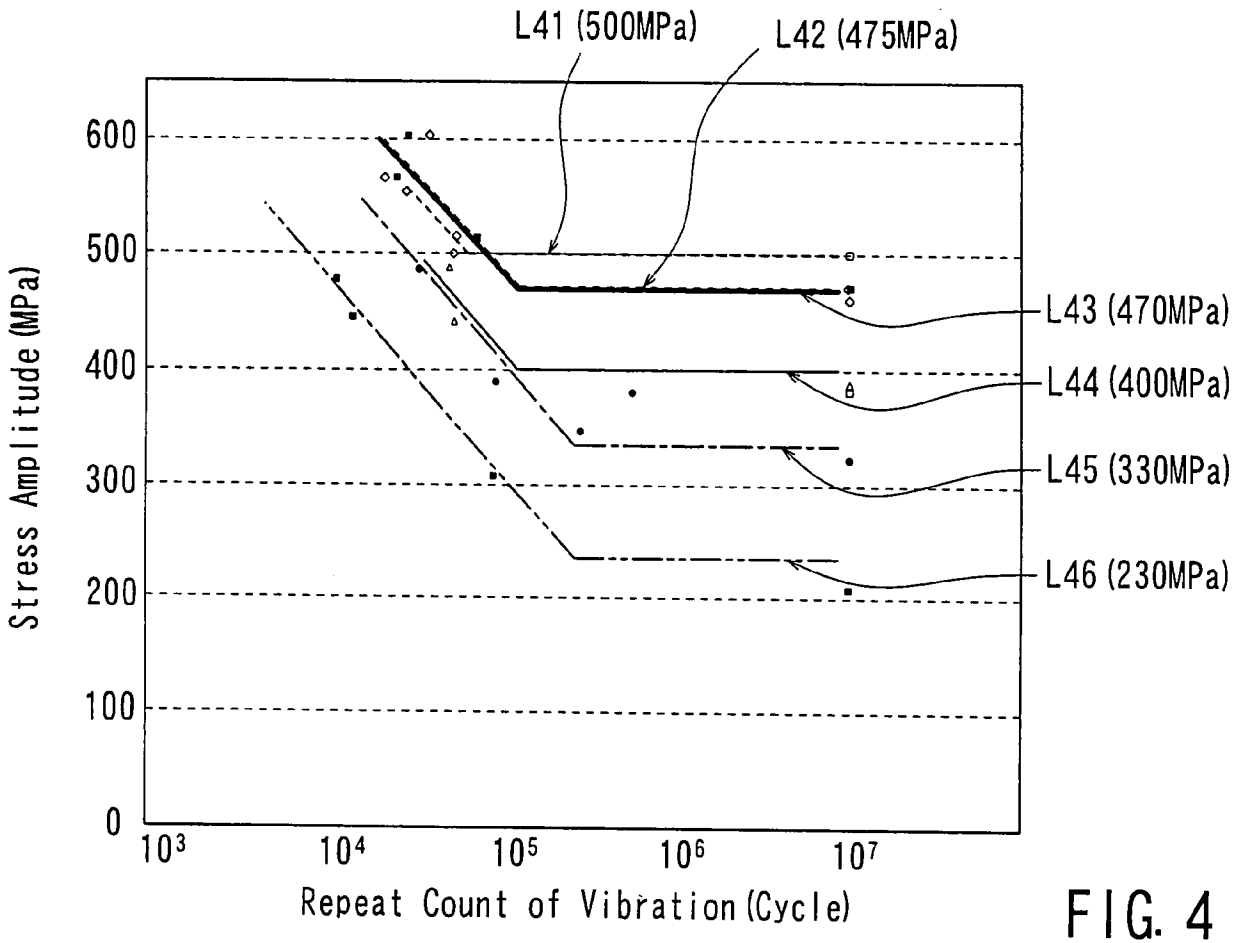
FIG. 4 is a graphs of stress amplitude against repeat count of vibration.

FIG. 4 shows the results of the fatigue strength tests with regard to the valve samples of Samples 1-6 (graphs of stress amplitude against repeat counts of vibration). Graphs L41-L46 respectively correspond to Samples 1-6.

As will be apparent from Graphs L41-L46 shown in FIG. 4, the higher treating temperature and the longer treating time may respectively tend to reduce or lower the fatigue strength of the valves 10. A reduction rate of the fatigue strength of Sample 2 relative to that of Sample 1 (Control) is 5%, which can be calculated by an equation [{(500−475)/500}×100]. Further, reduction rates of the fatigue strength of Samples 3, 4, 5, and 6, relative to Sample 1 (Control) are respectively 6, 20, 34, and 54%.

These results demonstrate that when the required fatigue strength is 300 MPa, Samples 2-5, not including Sample 6, can sufficiently satisfy such a requirement. As will be appreciated, even if higher fatigue strength is required, some of the Samples 2-5 can also satisfy such a higher requirement.

Second, a plurality of sets of actual samples of the actual engine valve 10 (Samples 7-12) are prepared and are oxidation treated under different treating conditions by changing treating temperatures and treating times. Treating conditions of these sets of samples are as follows:

Sample 7: Treating temperature of 670 degrees C. and treating time of 1-16 hour

Sample 8: Treating temperature of 700 degrees C. and treating time of 1-16 hour

Sample 9: Treating temperature of 730 degrees C. and treating time of 1-16 hour

Sample 10: Treating temperature of 760 degrees C. and treating time of 1-16 hour Sample 11: Treating temperature of 790 degrees C. and treating time of 1-16 hour Sample 12: Treating temperature of 820 degrees C. and treating time of 1-16 hour Fatigue strength tests are carried out with regard to these sets of samples (Samples 7-12) in the same manner as described above, except that the sample valves 10 of each of Samples 7-12 are measured under a constant repeat count (i.e., $10^7$) of vibration.

Figure 5:
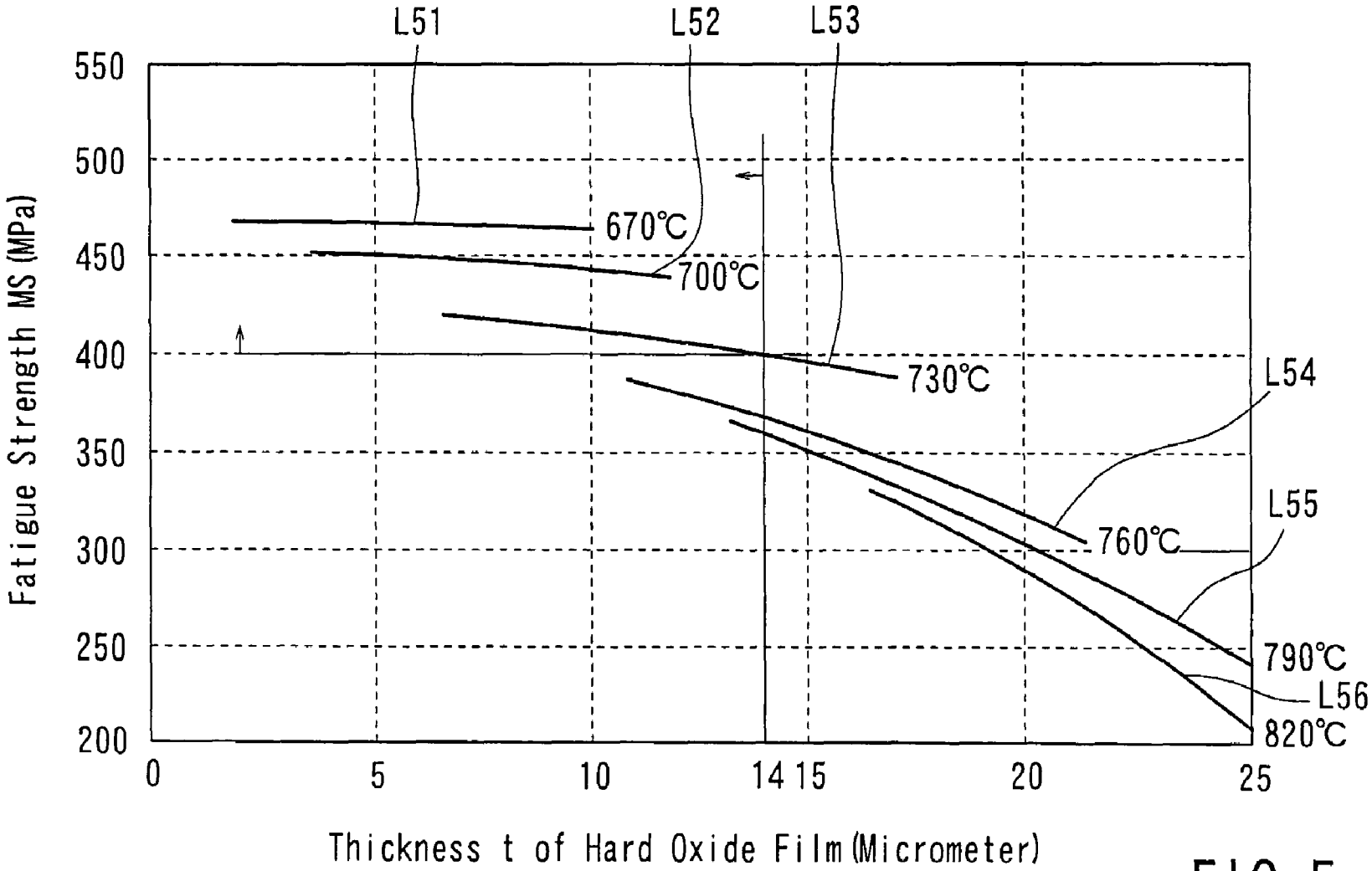
FIG. 5 is a graphs of fatigue strength against a thickness of the hard oxide film.

FIG. 5 shows the results of the fatigue strength tests with regard to the valve samples (graphs of stress amplitude or fatigue strength MS against a thickness t (FIG. 2) of the hard oxide film). Further, the tested sample valves 10 are limited to those valves having a hard oxide film (film thickness) that can provide the required hardness (i.e., not less than a Vickers hardness of 500 Hv). Graphs L51-L56 respectively correspond to Samples 7-12.

As will be apparent from Graphs L51-L56 shown in FIG. 5, the higher treating temperature and the longer treating time may tend to reduce or lower the fatigue strength MS of the valves 10. It is generally known in the art that the higher treating temperature and the longer treating time may tend to thicken the oxide film thickness t. This may be due to the "solution strengthening effect" of oxygen that is doped into the oxide film during the oxidation treatment.

These results demonstrate that when the reduction rate of the fatigue strength MS of the engine valves 10 relative to the fatigue strength (500 MPa) of Sample 1 (Control) is required to be held within 20%, Samples 7 and 8 can satisfy this requirement, although Samples 10-12 cannot satisfy this requirement. As will be apparent, with regard to Sample 9, some of the valves having a film thickness t not greater than 14 micrometers can satisfy this requirement, although some of the valves having a film thickness t greater than 14 micrometers cannot satisfy this requirement. (It is estimated that the film thickness of 14 micrometers substantially corresponds to a treating time of 11 hours.) Therefore, it is expected that such fatigue strength reduction rates can preferably be held lower than about 20% if the film thickness is appropriately controlled to be approximately 14 micrometers or less.

Figure 6:
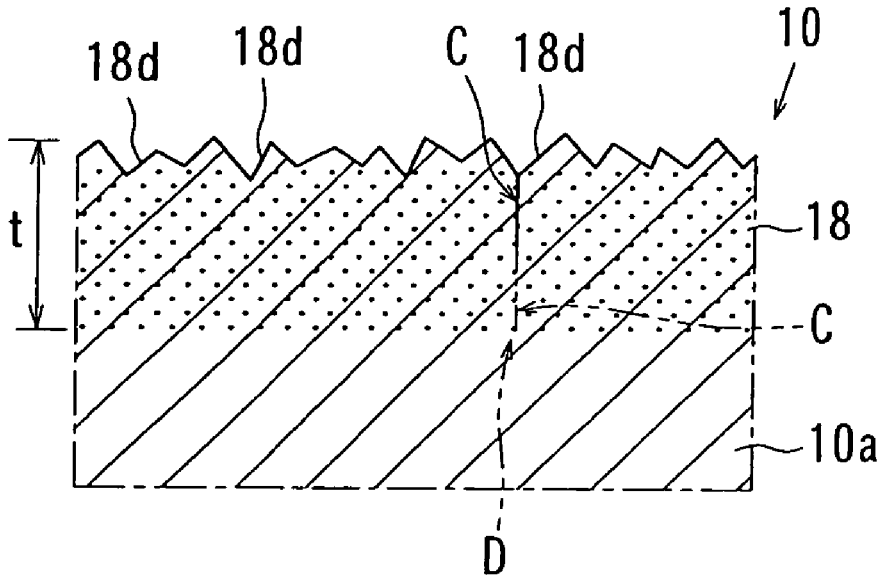
FIG. 6 is a partially enlarged cross-sectional view of the engine valve having a thicker hard oxide film.
Figure 7:
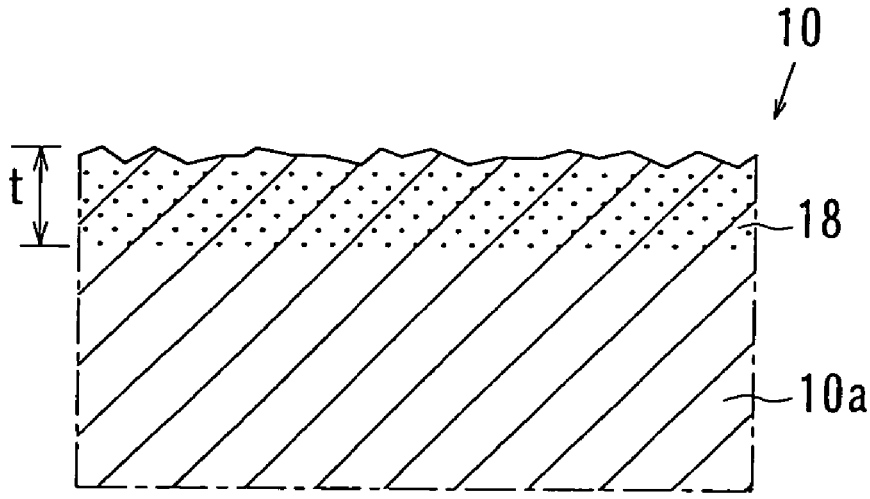
FIG. 7 is a partially enlarged cross-sectional view of the engine valve having a thinner hard oxide film.

The reasons that the thicker oxide film 18 may tend to reduce or lower the fatigue strength of the valves 10 will now be described with reference to FIGS. 6 and 7. FIG. 6 shows a partial sectional view of a valve 10 (which will be herein referred to as a first valve 10) that is oxidation treated at a higher temperature of 820 degrees C. for 4 hours. Subsequently, FIG. 7 shows a partial sectional view of a valve 10 (which will be herein referred to as a second valve 10) that is oxidation treated at a lower temperature of 670 degrees C. for 16 hours. As shown in FIGS. 6 and 7, the oxide film 18 of the first valve 10 is thicker than that of the second valve 10. As shown in FIG. 6, the thicker film 18 has a deteriorated surface condition or greater surface roughness, which may result in stress concentration. Such stress concentration may lead to formation of the crack C in the film 18. In addition, the formed crack C may readily extend or lengthen in the oxide film 18. Therefore, a crack C formed in the thicker film 18 may generally be longer than that formed in a thinner film 18. As a result, the stress concentrated to a forward end D of the extended crack C is relatively increased, so that the crack C further extends and goes into the base metal portion 10*a*. Such a long crack C may cause the fatigue strength of the engine valve 10 to be effectively reduced. Further, it is presumed that the deteriorated surface condition of the thicker film 18 results from the expansion of the film 18 due to the entering of oxygen into grooves 18*d* formed in the surface thereof or thermal contraction during cooling after the oxidation treatment.

On the contrary, as shown in FIG. 7, the thinner film 18 has a better surface condition or smaller surface roughness when compared with the thicker film 18. The thinner film 18 may effectively avoid much of the stress concentration of the thicker film, thereby effectively preventing crack formation in the thinner film 18. Even if a crack is formed in the thinner film 18, the overall stress concentration is minimized because such a crack is relatively short. In addition, such a crack does not usually continue to extend into the base metal portion 10*a*. Therefore, the thinner film 18 does not generally remarkably reduce the fatigue strength MS of the engine valve 10.

Thus, in order to prevent the crack formation in the film 18, it is essential that the film 18 have a better surface condition or a smaller degree of surface roughness. For example, when the engine valve 10 prior to the oxidation treatment has a surface roughness Rz of 1.5 micrometer, the oxidation treated engine valve 10 is required to have a surface roughness Rz of 3.0 micrometers or less after the oxidation treatment in order to effectively prevent the reduction of the fatigue strength MS (i.e., in order to hold the fatigue strength MS within a desired range).

Finally, two sets of samples of the actual engine valve 10 (Samples 13-15) are prepared and are oxidation treated under different treating conditions by changing the treating temperatures and the treating times. Thereafter, wear tests are carried out by utilizing a valve seat tester 30 (FIG. 8), in order to examine the relationship between the oxidation treating condition and the wear resistance. Treating conditions of these sets of samples are as follows:

Sample 13: Treating temperature of 730 degrees C. and treating time of 8 hours

Sample 14: Treating temperature of 670 degrees C. and treating time of 16 hour

Sample 15: Not treated (Control)

Figure 8:
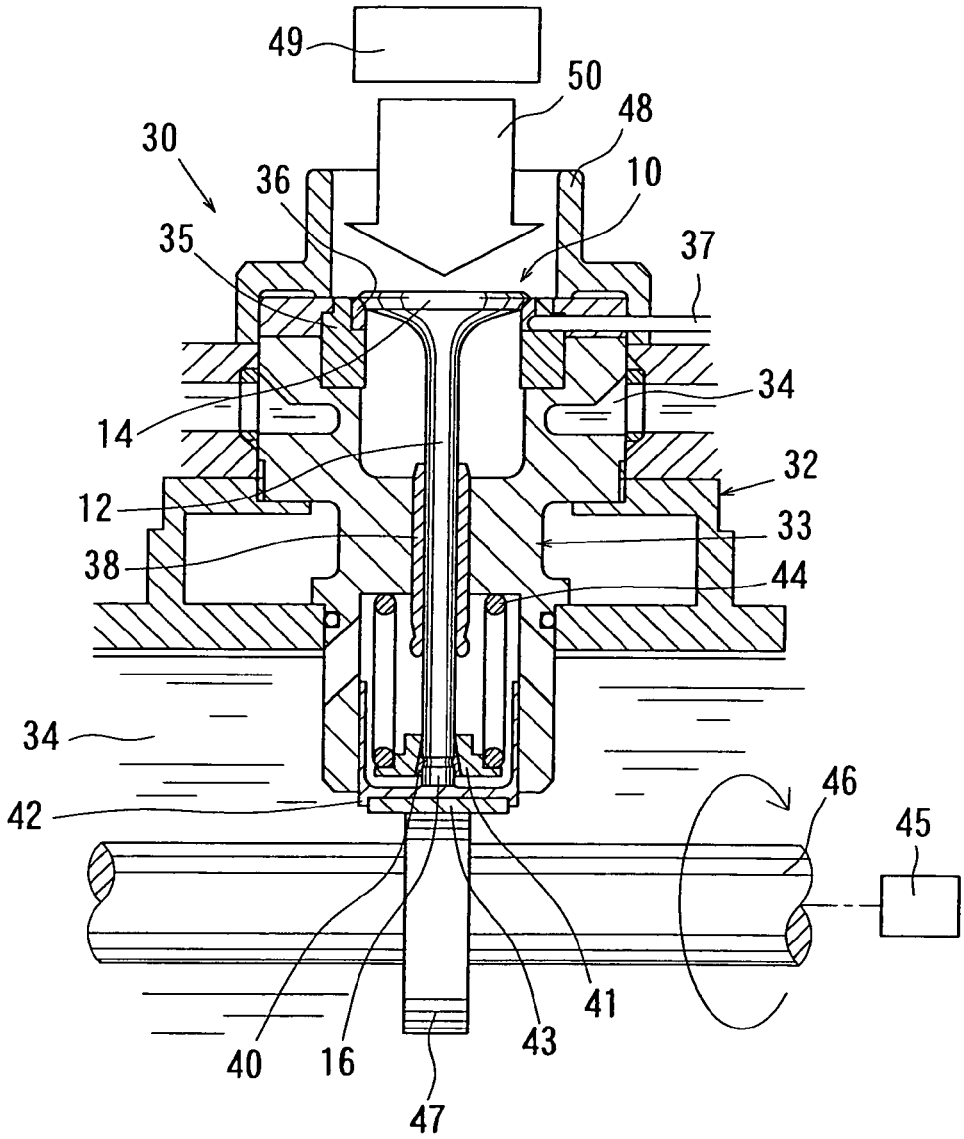
FIG. 8 is a cross-sectional view of a valve seat tester.

The valve seat tester 30 shown in FIG. 8 may preferably be constructed to simulate real relative motion between an engine valve and a valve seat in order to examine wear of both the engine valve and the valve seat. The valve seat tester 30 includes a support 32 and a valve holder 33 that is received in the support 32. The support 32 is formed with water jackets 34, in order to circulate cooling water around the upper and lower ends of the valve holder 33. The upper end of the valve holder 33 is provided with a seat support 35 on which a valve seat 36, made from a sintered alloy, is seated. In addition, the seat support 35 is provided with a thermocouple 37. The thermocouple 37 may preferably be arranged to measure the temperatures of the valve seat 36 in order to preferably control a gas burner 49 (which will be hereinafter described). Also, a valve guide 38 is positioned in the valve holder 33. The valve guide 38 vertically slidably receives the valve stem 12 of engine valve 10 therein, so that the valve face portion 14 of the valve 10 can periodically contact and separate away from the valve seat 36. The axial end 16 of the valve stem 12 is provided with a spring retainer 41 via a cotter 40. Also, the axial end 16 is provided with a lifter member 42 having a cam contact 43. A valve spring 44 is interleaved between the lifter member 42 and the valve holder 33, so that the engine valve 10 may be normally biased downwardly.

The valve seat tester 30 further includes a cam 47 fixedly attached to a camshaft 46 that can be rotated by an electric motor 45. The cam 47 is appropriately positioned on the camshaft 46, so that its outer cam surface can periodically contact the cam contact 43 of the lifter member 42 when the camshaft 46 is rotated. Therefore, when the camshaft 46 is rotated by the motor 45, the cam 47 attached thereto is rotated, thereby periodically and reciprocally moving the engine valve 10.

The valve seat tester 30 further includes the burner 49 that is disposed above an upper cylindrical portion 48 of the valve holder 33. The burner 49 is constructed to controllably project a liquid petroleum gas flame 50 into the upper cylindrical portion 48 so that both the valve seat 36 and the valve face portion 14 of the engine valve 10 can be effectively heated.

The wear tests are carried out by utilizing the valve seat tester 30 thus constructed. First, as shown in FIG. 8, the valve seat 36 and engine valves 10 of each set of samples are installed into the valve seat tester 30. Thereafter, the valve seat 36 and the valve face portion 14 of the engine valve 10 are heated and are maintained at approximately 200 degrees C. and 350 degrees C., respectively. Subsequently, the camshaft 46 is rotated at a desired rotation speed (e.g., 3500 rpm) by the motor 45 so that the engine valve 10 is periodically and reciprocally moved. Thus, actual relative motion of the engine valve 10 and the valve seat 36 in an engine is preferably simulated. After the camshaft 46 is continuously rotated for 4 hours, the engine valve 10 and the valve seat 36 are removed from the tester 30 and their wear losses are measured. The wear tests of Samples 13-15 are respectively carried out two times, thereby obtaining an average wear loss W for the sample valves 10 of each of Samples 13-15 and the corresponding valve seats 36.

Figure 9:
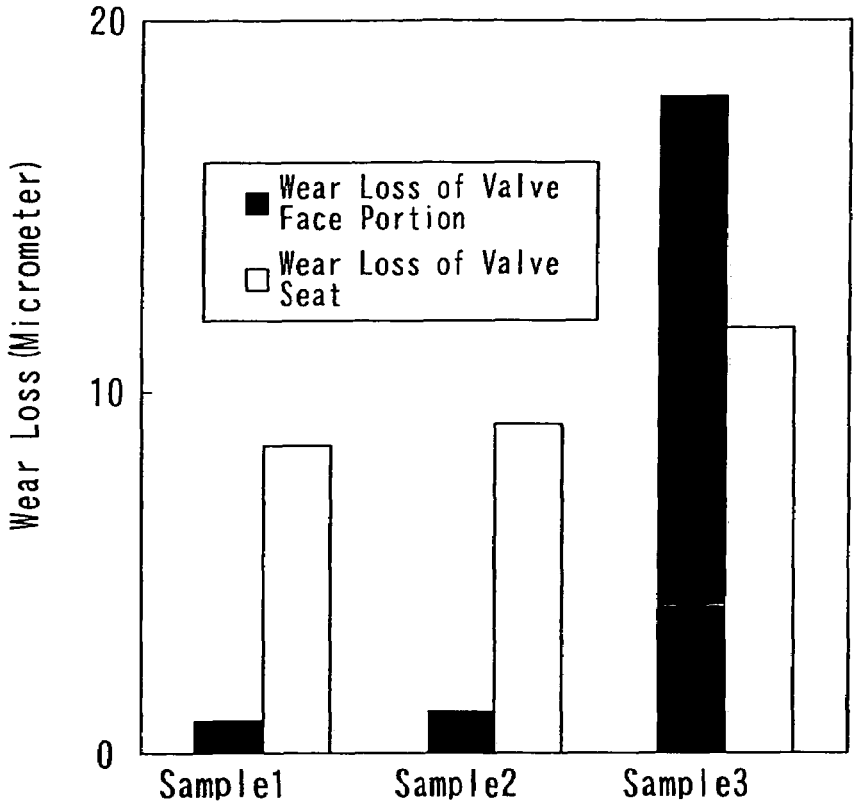
FIG. 9 is graphs showing results of the wear tests.
Figure 10:
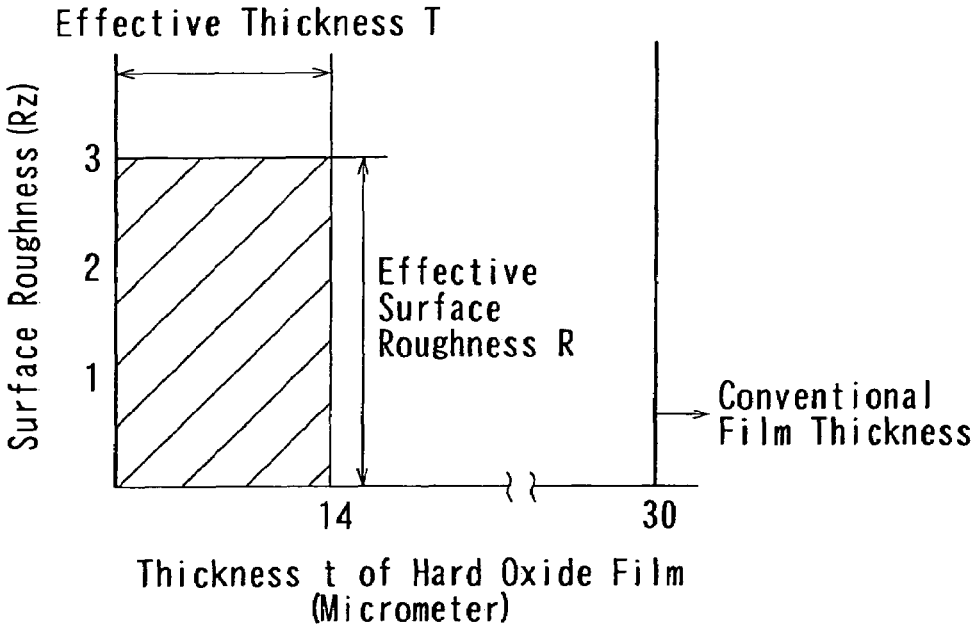
FIG. 10 is a graph showing an effective area that can satisfy effective thickness and effective surface roughness.

FIG. 9 shows the results (i.e., graphs of the wear losses) of the wear tests with regard to the engine valves 10 of Samples 13-15 and the corresponding valve seats 36. As will be appreciated, the average wear losses W are represented by thicknesses (micrometers).

As will be apparent from the graphs shown in FIG. 9, the average wear losses W of the valves 10 (valve face portions 14) of Samples 13 and 14 are extremely lower than the wear loss W of the valves 10 of Sample 15 (Control). That is, the wear losses W of the valves 10 of Samples 13 and 14 are respectively only 5-7% relative to the wear loss W of the valves 10 of Sample 15. On the other hand, the average wear losses W of the valve seats 36 corresponding to the valves 10 of Samples 13 and 14 are respectively only 72-78% relative to the wear loss W of the valve seats 36 corresponding to the valves 10 of Sample 15. These results demonstrate that the treated engine valve 10 (the treated valve face portion 14) of Samples 13 and 14 may have excellent wear resistance. Also, these results demonstrate that the treated valve face portion 14 of the valve 10 of Samples 13 and 14 may contribute to reduce the wear loss of the valve seat 36.

In view of the results of the tests described above, an appropriate surface treating method of the engine valve 10 (titanium part) comprises the following steps. In a first step, from a correlation of the hardness against the film thickness t of the hard oxide film 18 formed on a surface of the valve 10, an effective thickness of the hard oxide film 18 corresponding to a required film hardness is determined. The effective thickness is, for example, 14 micrometers or less (FIG. 5).

In a second step, from a correlation of the hardness against the surface roughness of the hard oxide film 18, effective surface roughness of the hard oxide film 18 corresponding to the required film hardness is determined. The effective thickness is, for example, 3.0 Rz or less.

In a third step, the engine valve 10 is oxidation treated under the desired treating conditions (i.e., desired treating temperature and treating time) such that both of the determined effective thickness and effective surface roughness are satisfied. Further, an effective area that can satisfy both the effective thickness T and the effective surface roughness R is shown by hatching in FIG. 10.

The present surface treating method can produce an engine valve 10 that has the required fatigue strength and wear resistance.

Further, the hard oxide film 18 of the valve 10 can be post treated, for example, by shot blasting, buffing or other similar methods, in order to reduce its surface roughness. Such post treating may effectively contribute to increase the fatigue strength of the valve 10. The post treating may also contribute to reduced wear losses of contact members (e.g., oil seals) that slidably contact the valve stem 12 of the valve 10.

Although the titanium engine valve 10 is exemplified as the titanium part in this representative embodiment, any other engine components (e.g., spring retainers and valve springs), a golf club shaft, or other similar members also can be used as the titanium part, if necessary. In addition, although the Ti-6Al-4V alloy is selected in this embodiment, any other α-β titanium alloys (e.g., Ti-3Al-2.5V alloy), α titanium alloys or β titanium alloys can be selected, if necessary. Further, in this embodiment, the titanium engine valve 10 is made from a single material (Ti-6Al-4V alloy) and is entirely treated by the oxidation treatment. However, the valve 10 can be made from a plurality of materials including materials other than titanium materials (e.g., SUH3 steel) and be only partly treated by the oxidation treatment, if necessary. Further, although forging in this embodiment forms the valve 10, machining, sinter forming, or other similar methods, can form the valve 10.

A representative example of the present invention has been described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the foregoing detailed description may not be necessary to practice the invention in the broadest sense, and are instead taught merely to particularly describe detailed representative examples of the invention. Moreover, the various features taught in this specification may be combined in ways that are not specifically enumerated in order to obtain additional useful embodiments of the present teachings.

The invention claimed is:

1. A method for restricting the reduction rate of fatigue strength of a titanium part subjected to surface oxidation treatment, comprising the steps of:

correlating hardness of a hard oxide film to be formed on a surface of the titanium part against thickness of the film to determine an effective thickness corresponding to a predetermined desired film hardness;

correlating the hardness against surface roughness of the hard oxide film to determine an effective surface roughness corresponding to the desired film hardness; and oxidation treating the surface of the titanium part under conditions of temperature and time such that both of the effective thickness and effective surface roughness corresponding to the desired film hardness are obtained, wherein the effective thickness is 14 micrometers or less, and the effective surface roughness Rz is 3.0 micrometers or less.

2. A method as defined in claim 1, wherein the desired treating temperature is 730 degrees C. or less.

3. A method as defined in claim 1 further comprising the step of treating the surface of the titanium part after the oxidation treating step.

4. A method as defined in claim 1, wherein reduction rate of the fatigue strength is less than 20%.

* * * * *